US005881747A

United States Patent [19]

Uchino

[11] Patent Number: 5,881,747

[45] Date of Patent: Mar. 16, 1999

[54] WASHING APPARATUS

[75] Inventor: Masahide Uchino, Tokyo, Japan

[73] Assignee: Japan Field Co., Ltd., Tokyo, Japan

[21] Appl. No.: 930,150

[22] PCT Filed: Feb. 14, 1997

[86] PCT No.: PCT/JP97/00399

§ 371 Date: Nov. 12, 1997

§ 102(e) Date: Nov. 12, 1997

[87] PCT Pub. No.: WO97/29860

PCT Pub. Date: Aug. 21, 1997

[30] Foreign Application Priority Data

Feb. 15, 1996 [JP] Japan ..... 8-028342

[51] Int. Cl.[6] ..... B08B 3/04

[52] U.S. Cl. ..... 134/88; 134/133; 134/135; 134/164

[58] Field of Search ..... 134/86, 88, 133, 134/135, 164, 85, 92, 61; 34/77, 60, 380; 118/423, 428

[56] References Cited

U.S. PATENT DOCUMENTS

| | | | |
|---|---|---|---|
| 294,346 | 3/1884 | Atkins | 134/135 |
| 3,096,774 | 7/1963 | Rand | 134/79 |
| 3,401,705 | 9/1968 | Goldware | 134/57 |
| 4,714,086 | 12/1987 | Kishida | 134/135 |
| 4,867,186 | 9/1989 | Otsuka | 134/111 |
| 5,494,531 | 2/1996 | Azuma | 134/25.4 |

FOREIGN PATENT DOCUMENTS

| | | |
|---|---|---|
| 63-41636 | 8/1988 | Japan . |
| 1-242183 | 9/1989 | Japan . |
| 5-261347 | 10/1993 | Japan . |

*Primary Examiner*—Frankie L. Stinson
*Assistant Examiner*—Mialeeka C. Williams-Bibbs
*Attorney, Agent, or Firm*—Kanesaka & Takeuchi

[57] ABSTRACT

Two vats are arranged vertically within an occupied area for a single vat, and any of the upper and lower vats can implement washing works at the same time. The upper and lower vats are used simultaneously according to the object of washing, enabling the apparatus to implement quick washing works of articles to be washed within the compact space. An upper vat (15) capable of containing the articles (12) is formed above the lower vat (10) capable of containing the articles (12). A loading and unloading space (14) for articles (12) is formed between the upper and lower vats (15), (10). This apparatus is formed with a lower vertical mover (19) for loading and unloading the articles (12) in and out of the lower vat (10) and an upper vertical mover (18) for loading and unloading the articles (12) in and out of the upper vat (15). The articles (12) are contained in the upper and lower vats (15), (10) at the same time, thereby enabling the apparatus to implement washing related works at the same time.

12 Claims, 17 Drawing Sheets

WASHING APPARATUS

TECHNICAL FIELD

This invention relates to a washing apparatus for washing mechanical parts, electrical parts, medical parts, etc.

BACKGROUND ART

Articles subject to washing are conventionally washed by being dipped in a washing liquid, spraying washing liquid toward the articles in a showery manner, or steaming the articles to render the articles wet. Those articles are also subject to drying after washing. Such washing related works are generally constituted of several combined works to perform washing.

When an article is subject to different washing related works of multiple types, a washing apparatus is conventionally used in which washing processing vats (1) such as a dip washing vat, a shower washing vat, a steam washing vat, a drying vat, etc. are laterally placed in series to wash the articles (2) by conveying the articles sequentially. This apparatus becomes extremely large and needs a larger occupied area, and therefore, requires larger size factory facilities, which are not favorable for users.

To overcome such difficulties, an apparatus is formed to place, vertically of washing vats, locations for different washing related works. For example, disclosed in Japanese Patent Publication Hei 3-58,789 is an invention in which a dip washing vat filled with washing liquid is formed at a lower end and a steam washing vat is formed above the dip washing vat. Thus, dip washing and steam washing can be performed within a single occupied area of a washing-processing vat by transferring the articles vertically, where washing related works of different types are done at locations vertically apart from each other. This method advantageously makes the washing area smaller.

The method to place the washing vats vertically has an advantage that the articles can be washed without a larger area. However, when articles to be washed are loaded in the dip washing vat, steam washing cannot be performed; when the articles are loaded in the steam washing vat, the dip washing vat cannot contain the articles. Therefore, though the apparatus advantageously makes the volume of the washing vats smaller, washing time is not less than the washing time of a prior art washing machine having laterally placed vats in no series.

In particular, since usage of 1,1,1-trichloroethane, fluorocarbon, etc. is restricted these days, petrolic washing liquid, alcoholic washing liquid, washing water, etc. are used frequently. Those washing liquids, however, require more time to do washing related works such as washing, drying, etc. Apparatuses for such washing processes therefore become larger in comparison with conventional washing vats for 1,1,1-trichloroethane, fluorocarbon, etc. and become unfavorable for users.

DISCLOSURE OF INVENTION

To solve the above problems, this invention provides a compact size washing apparatus promptly performing washing related works without occupying a larger area.

This invention comprises a lower vat capable of containing articles to be washed, an upper vat, disposed above the lower vat, capable of containing the articles, a lower vertical mover for the lower vat to load and unload the articles in and from the lower vat, and an upper vertical mover for the upper vat to load and unload the articles in and from the upper vat.

The articles to be washed are contained at the same time in the upper and lower vats, thereby rendering washing related works performed at the same time.

The washing related works may include dip washing, shower liquid washing, steam washing, and drying of the articles. The upper vertical mover can be made of a cylinder or a lift; the lower vertical mover can be made of a cylinder. An upper table may be connected to the upper vertical mover to mount the articles to be washed; a lower table may be connected to the lower vertical mover via a covering support to mount the articles to be washed. The upper table may be able to seal a bottom opening of the upper vat while the articles are contained in the upper vat. The covering support may be able to seal a top opening of the lower vat while the lower vat contains the articles with an aid of the lower table.

When the articles are to be washed, the articles are placed at a loading and unloading space for articles formed between the upper and lower vats. At a time that the articles are placed, the table for articles moves to the loading and unloading space for articles by operating the upper or lower vertical mover. After placing the articles on the table, the articles are contained in the upper or lower vat. For example, when the articles are to be contained in the lower vat, the articles are subject to certain washing related works such as dip washing, shower washing, steam washing, etc. while the articles are contained in the lower vat. At the same time, the upper vertical mover for the upper vat is operated to place the table for articles at the loading and unloading space for articles, and then, the articles are put on the table. The upper vertical mover is operated to render the upper vat contain the articles, which are subsequently subject to the washing related works. These washing related works can be such as dip washing, shower washing, steam washing, drying as users' will.

According to this apparatus, the upper and lower vats are disposed vertically at an area not more than for a single washing vat, thereby simultaneously performing washing related works for the articles at upper and lower locations, and thereby being capable of working on two jobs within the area for a single vat. Therefore, this apparatus can do washing works very quickly in view of occupied area basis. After the washing related works are completed, the upper or lower vertical mover is operated to introduce the articles to the loading and unloading space for articles. The apparatus then takes out the articles through the loading and unloading space to convey the articles for subsequent processes otherwise completes the washing works.

The washing related works done at the upper and lower vats may be the same and may be different from one another. For example, when dip washing process as a primary process is completed in a short period and drying process requires much time, both of the upper and lower vats are used as drying vats, thereby capable of shortening drying period per article. In association with the dip washing work as a primary process, the lower vat is used for steam washing work while the upper vat is used for drying work, so that washing related works can be widely selected and combined arbitrarily corresponding to the object of washing. Although the washing of articles at the upper and lower vats is possibly done at the same time at both vats, it is not necessary to operate the upper and lower vats always at the same time. There is no problem to do washing works with only either of the upper and lower vats according to necessity. That is, it is at least required for the apparatus that the upper and lower vats are possibly used at the same time to perform the washing related works.

Since this invention is thus constructed, or since the two vats are formed vertically within an area for a single vat and any of the vats is capable of washing at the same time, the apparatus can do washing articles quickly within a compact space in use of the upper and lower vats at the same time according to the object of washing.

BEST MODE FOR CARRYING OUT THE INVENTION

Figure 1:
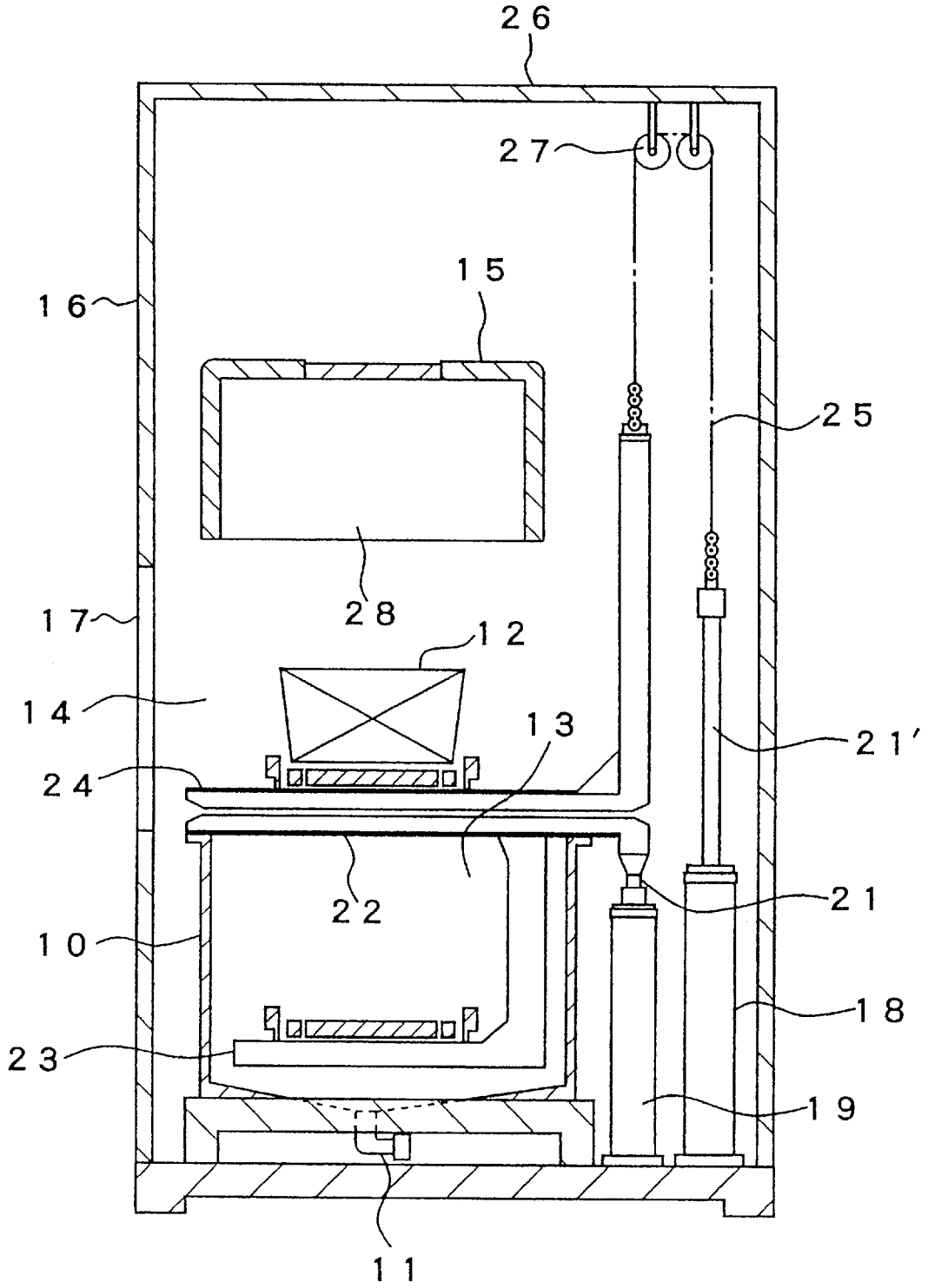
FIG. 1 is a cross section of a state that an upper table is placed at a loading and unloading space and mounts articles to be washed.

Referring to drawings, for describing an embodiment of the invention, numeral (10) is a lower vat, which has a drain (11) for draining washing liquid at a bottom of the vat and a top opening (13) for loading and unloading articles to be washed at a top of the vat. An upper vat (15) is disposed above the lower vat (10) via a loading and unloading space (14) for articles (12).

A casing (16) covers the upper and lower vats (15), (10) to prevent solvents or the like from splashing and ensure safety of the works. An opening (17) for articles (12) is formed in the casing (16) at a position corresponding to a position of the loading and unloading space (14) for articles (12). An upper vertical mover (18) and a lower vertical mover (19) are independently disposed in the casing (16) as to oppose to side faces of the upper and lower vats (15), (10).

The upper and lower vertical movers (18), (19) are constituted of cylinders such as air cylinders, oil cylinders, etc. The lower vertical mover (19) has a covering support (22) perpendicularly projecting from a top end of a piston (21) movable up and down in extending from the cylinder, and a lower table (23) for putting the articles (12) thereon extends in an L-shape at a lower face of the covering support (22). The covering support (22) has an area capable of sealing the top opening (13) of the lower vat (10). The lower table (23) is inserted in the lower vat (10) by the lower vertical mover (19) and movable down to a position that the articles (12) are to be washed. The lower table (23) is also formed to project from the top face of the lower vat (10), thereby being capable of bringing the articles (12) at the loading and unloading space (14).

The upper vertical mover (18) is connected to an upper table (24) by a chain (25), because the mover needs to operate the upper table (24) over the lower vertical mover (19). The upper table (24) is movable up and down by connecting the chain (25) to a piston (21') of the cylinder forming the upper vertical mover (18) via a sprocket (27) formed at a lower face of a frame that holds a ceiling board (26) of the casing (16). The upper table (24) can place the articles (12) at the loading and unloading space (14) for articles (12) and has a sliding distance enabling the apparatus to insert the articles (12) into the upper vat (15) when moved up by the upper vertical mover (18). The upper vat (15) is formed with a bottom opening (28) allowing the articles (12) to be in and out at the bottom of the vat. The upper vat (15) is so constituted as to be able to seal the bottom opening (28) by the upper table (24) while the articles (12) are contained in the upper vat (15). Similarly, the lower vat (10) is so constituted as to be able to seal, while the articles (12) are contained in the lower vat (10), the top opening (13) by the covering support (22) that connects the lower table (23) on the lower side of the support.

Although not shown in the drawings, the lower and upper vats (10), (15) are connected to various mechanisms inevitable to implement the washing related works. For example, the apparatus may be equipped with pipes for introducing or draining washing liquids, shower nozzles, various types sensors, etc. Moreover, the apparatus can be equipped arbitrarily with any washing related machine; a vacuum pump or the like may be provided to allow reduced pressure drying; the apparatus may be connected to a steam generation vat to allow to introduce steam washing; an ultrasound oscillator may be provided inside to allow ultrasound washing or cleaning.

With the apparatus thus constituted, the apparatus can contain the articles (12) first in the upper vat (15) or first in the lower vat (10), in order to wash the articles (12). Now, steps that the articles (12) are to be inserted in the upper vat (15) are exemplified.

First, as shown in FIG. 1, after the lower vertical mover (19) is moved down to the lowermost position, the upper vertical mover (18) is operated to move to the lowermost position to render the upper table (24) travel to the loading and unloading space (14) for articles (12). The articles (12) are put on the upper table (24) located at the loading and unloading space (14) for articles (12) by way of the opening (17) of the casing (16).

Figure 2:
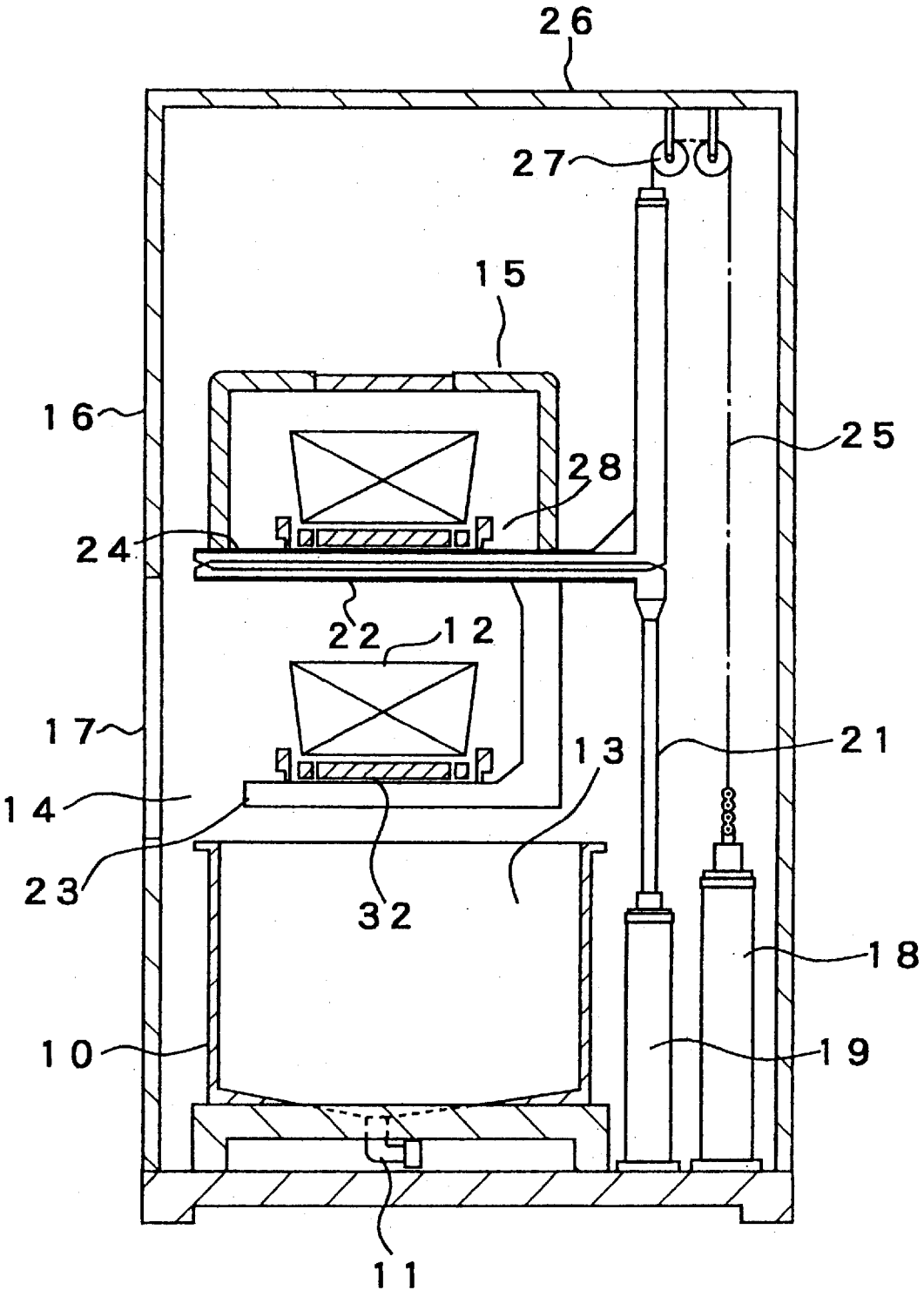
FIG. 2 is a cross section of a state that the articles are put on the upper table and a lower table and the articles on the upper table are contained in an upper vat.

As shown in FIG. 2, the upper vertical mover (18) is moved up, as well as the lower vertical mover (19) is operated to move up; the upper table (24) is in tight contact with the bottom opening (28) of the upper vat (15), thereby rendering the articles (12) contained in the upper vat (15). With this situation, the washing related works may be started in the upper vat (15), or the works may be started after the articles (12) are contained in the lower vat (10) as described below. This can be selected arbitrarily in accordance with the object of washing. It is desirable that the top and bottom openings (13), (14) formed at the upper and lower vats (15), (10) are sealed with the upper table (24) and the covering support (22) when the washing related works are performed. However, it is unnecessary to seal the openings when nothing affects external surroundings, e.g., when hot air drying of water washed articles (12), and the apparatus may maintain more or less air communication with external air.

Figure 3:
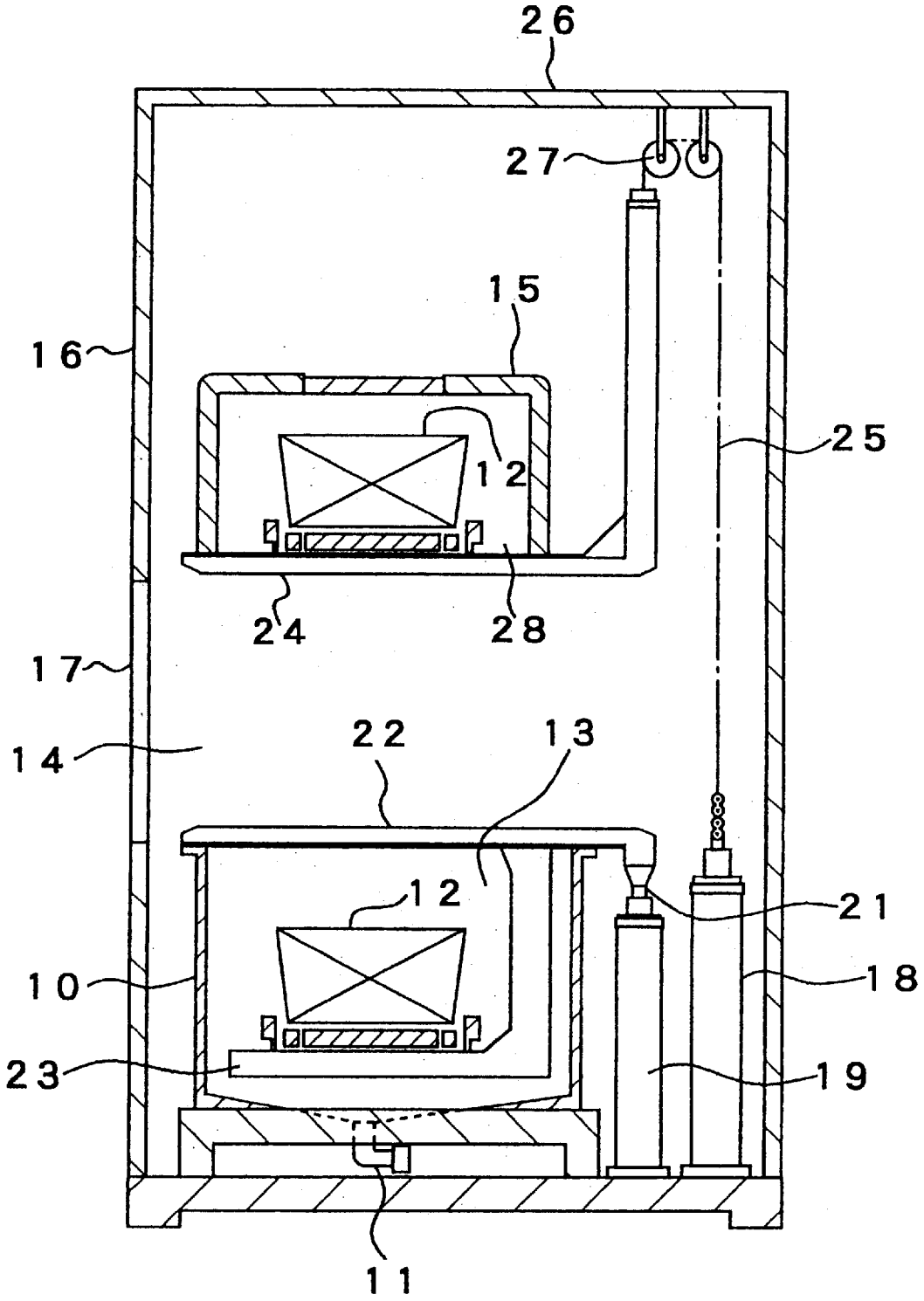
FIG. 3 is a cross section of a state that the articles on the upper and lower tables are contained in the upper and lower vats, respectively.

The articles (12) are put as shown in FIG. 2 on the lower table (23) placed at the loading and unloading space (14) for articles (12). The lower vertical mover (19) is then operated to move down to render the lower vat (10) contain the lower table (23), thereby rendering the articles (12) contained separately in the upper and lower vats (15), (10) as shown in FIG. 3. With this situation, the same or independent washing related works are done in the upper and lower vats (15), (10).

When each or either of the washing related works are completed, the articles (12) are placed at the loading and unloading space (14) for articles (12) from the first completed vat between the upper and lower vats (15), (10) by operating either of the upper and lower vertical movers (18), (19) on the side of the first completed vat. Then, these articles are taken out to complete the washing works or introduce the articles (12) to the subsequent washing process.

Figure 4:
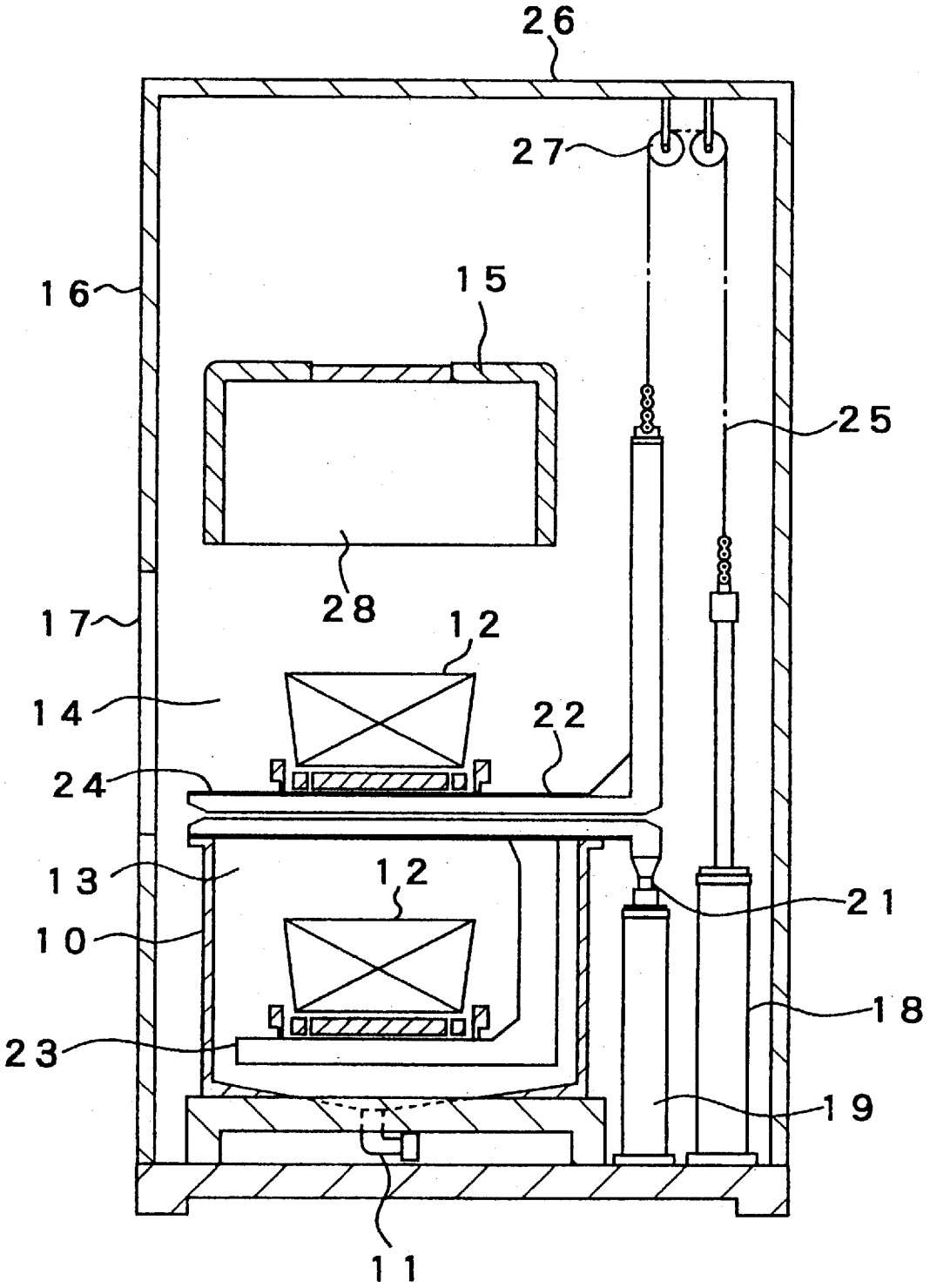
FIG. 4 is a cross section of a state that the articles on the upper table are placed at the loading and unloading space and the articles on the lower table are contained in the lower vat.
Figure 5:
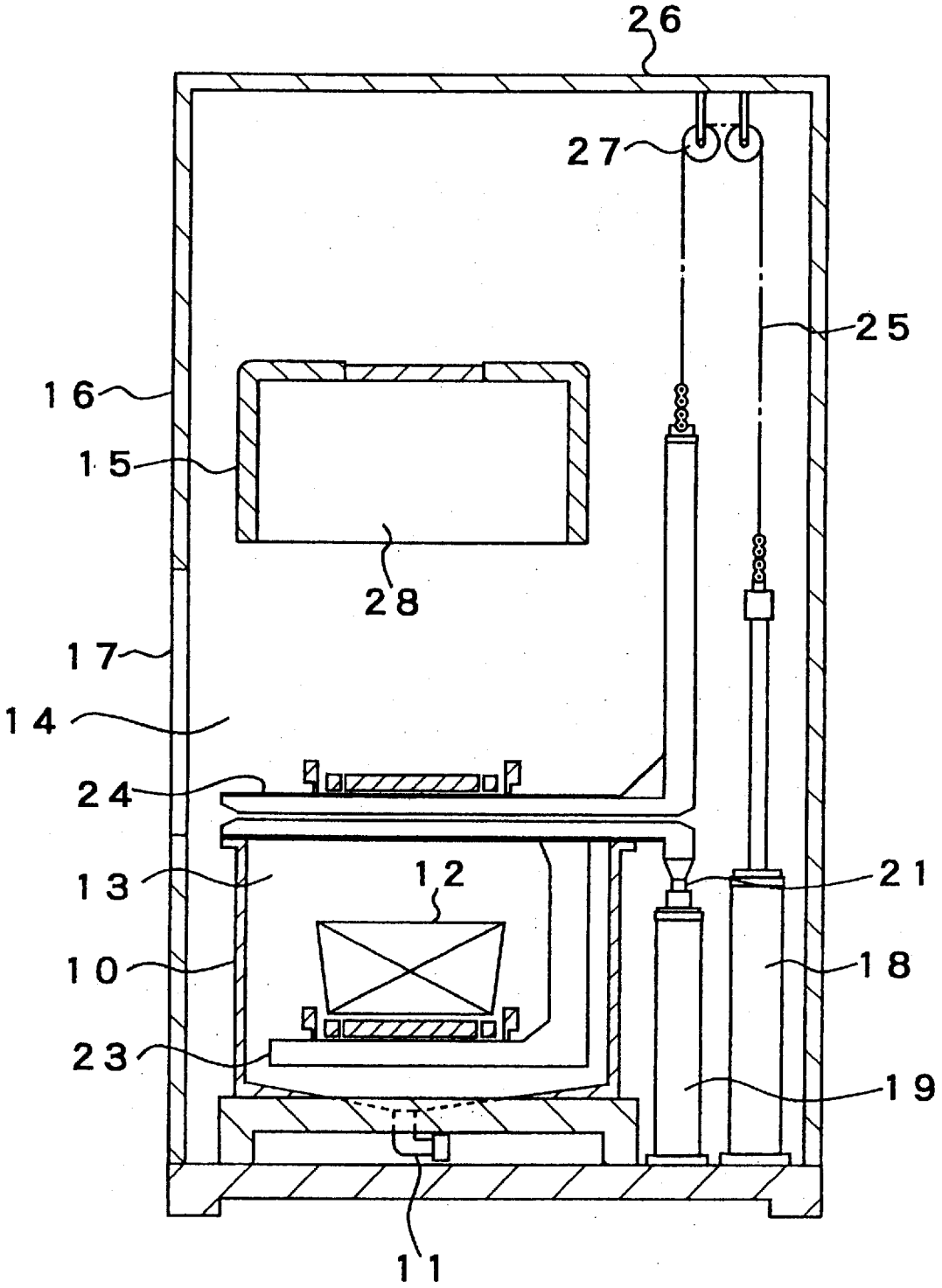
FIG. 5 is a cross section of a state that the articles on the upper table are taken out of the loading and unloading space and the article on the lower table are contained in the lower vat.
Figure 6:
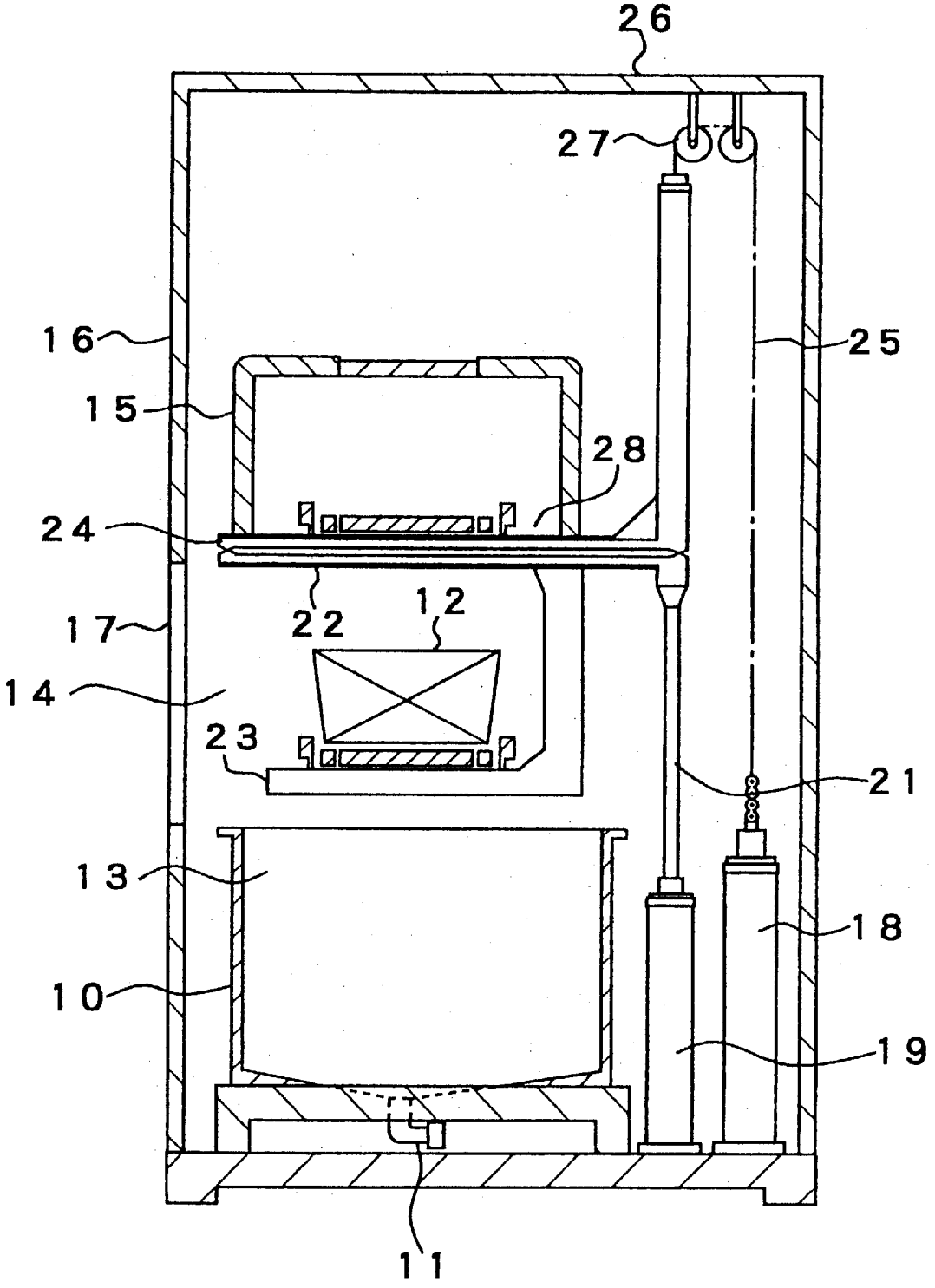
FIG. 6 is a cross section of a state that the upper and lower tables are moved up after the state shown in FIG. 5 and then the articles on the lower table are placed is at the loading and unloading space.

At the same time, other articles can be newly put on the upper or lower table (24), (23). For example, as shown in FIG. 3, after the articles (12) are contained in the upper and lower vats (15), (10), respectively, and the washing is completed, the upper vertical mover (18) is, as shown in FIG. 4, operated to move the upper table (24) down at the loading and unloading space (14), and thereby the articles (12) on the upper table (24) are removed as shown in FIG. 5. Subsequently, the upper and lower vertical movers (18), (19) are moved up, respectively, as shown in FIG. 6, and where the lower table (23) is placed at the loading and unloading space (14), the articles (12) are taken out of the opening (17) to the outside of the apparatus.

Sequences for moving up and down of the upper and lower tables (24), (23) and steps for putting the articles (12) on the tables can be determined flexibly according to the object of works. For example, if FIG. 2 shows a state that the articles (12) subsequently subject to washing are put on the lower table (23) after washing of the articles (12) is completed in the upper vat (15), new articles (12) are contained in the lower vat (10) upon moving the upper table (24) down after the lower vertical mover (19) is moved down, while the articles (12) that have already been washed are placed at the loading and unloading space (14) from the upper vat (15) that have completed the washing work, and then these articles can be taken out.

As described above, this invention allows the upper and lower vats (15), (10) mutually to wash the articles (12) at the same time where the upper and lower vats (15), (10) contain the articles (12) at the same time. Therefore, the invention makes possible quick washing works in use of the compact, fast apparatus with a less occupied area.

Figure 7:
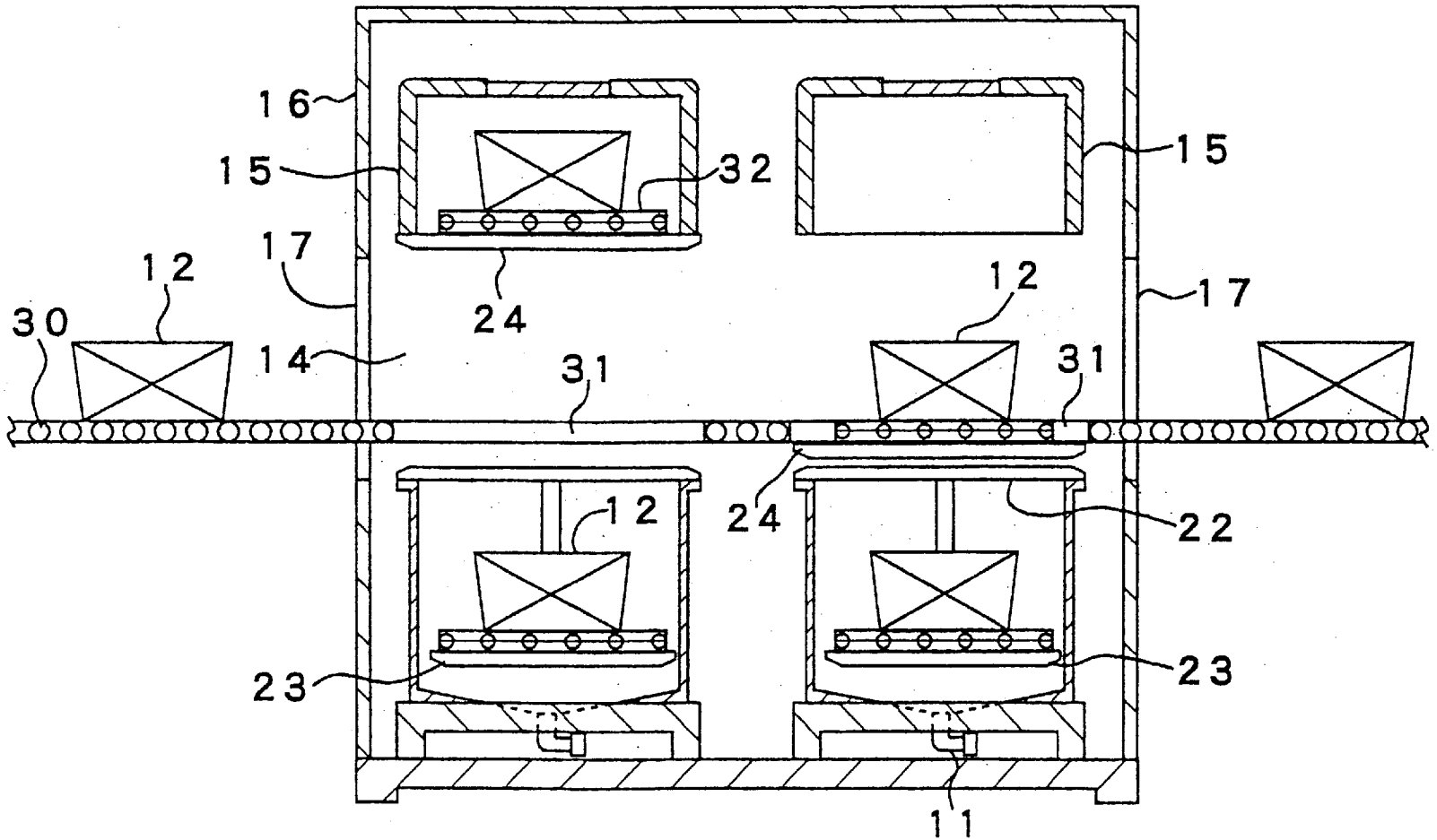
FIG. 7 is a cross section of a state that upper and lower vats, two of each, are provided to adjacent to one another.
Figure 10:
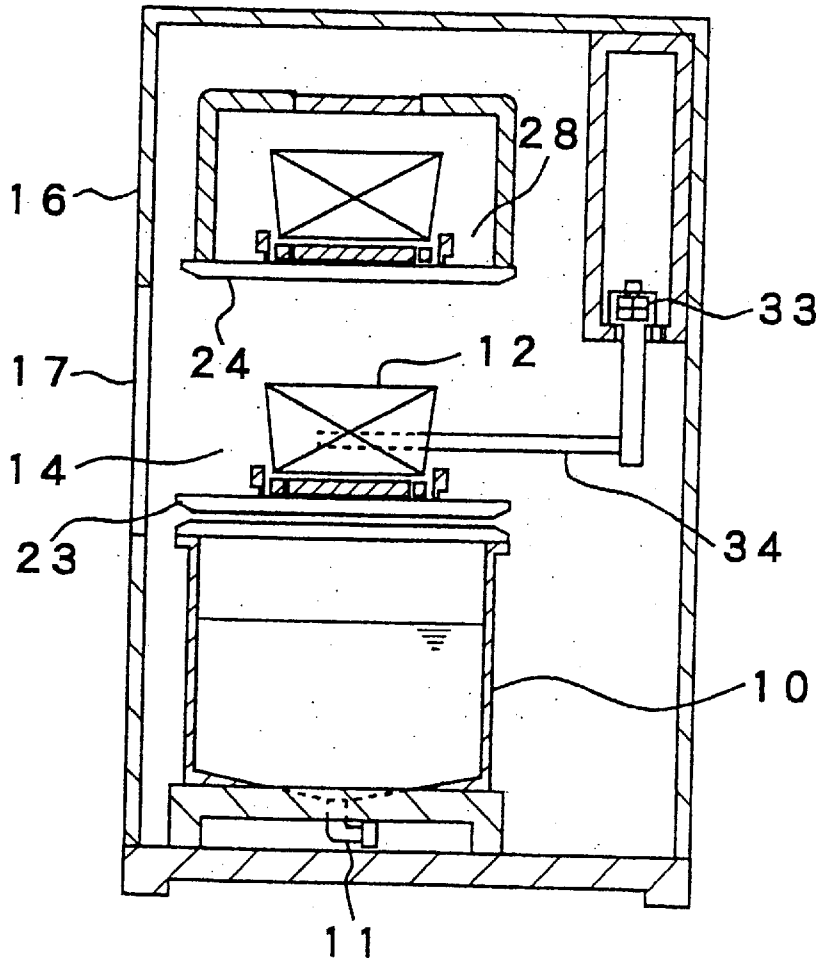
FIG. 10 is a cross section showing a feed mechanism for articles put on a roller conveyer.

Although the washing related works are possibly done at the same time at the upper and lower vats (15), (10), it is not necessary to operate the upper and lower vats (15), (10) always at the same time. It is possible, as a matter of course, to do washing works with only either of the upper and lower vats (15), (10) according to the object of works. Although in the embodiment above one each of the upper and lower vats (15), (10) is disposed vertically, in another embodiment, as shown in FIG. 7, a roller conveyer (30) is arranged as to face the loading and unloading space (14) for articles (12), and a passing opening (31) is formed around the loading and unloading space (14) of the roller conveyer (30) to pass the articles (12) and the upper and lower tables (23), (24). Conveyers (32), which are corresponding to the roller conveyer (30), are disposed on the top face of the upper and lower tables (23), (24), so that the articles (12) can be readily transferred when the upper and lower tables (23), (24) are placed at the loading and unloading space (14). The apparatus thus constituted allows effective quick washing works while readily transferring the articles (12) in a lateral direction, where multiple sets of the upper and lower vats (15), (10) are provided in series. The transfer of the articles (12) in this apparatus is, as shown in FIG. 10, done by pushing onto the articles (12) a pushing bar (34) which is moved by a chain drive mechanism (33) or the like.

Figure 8:
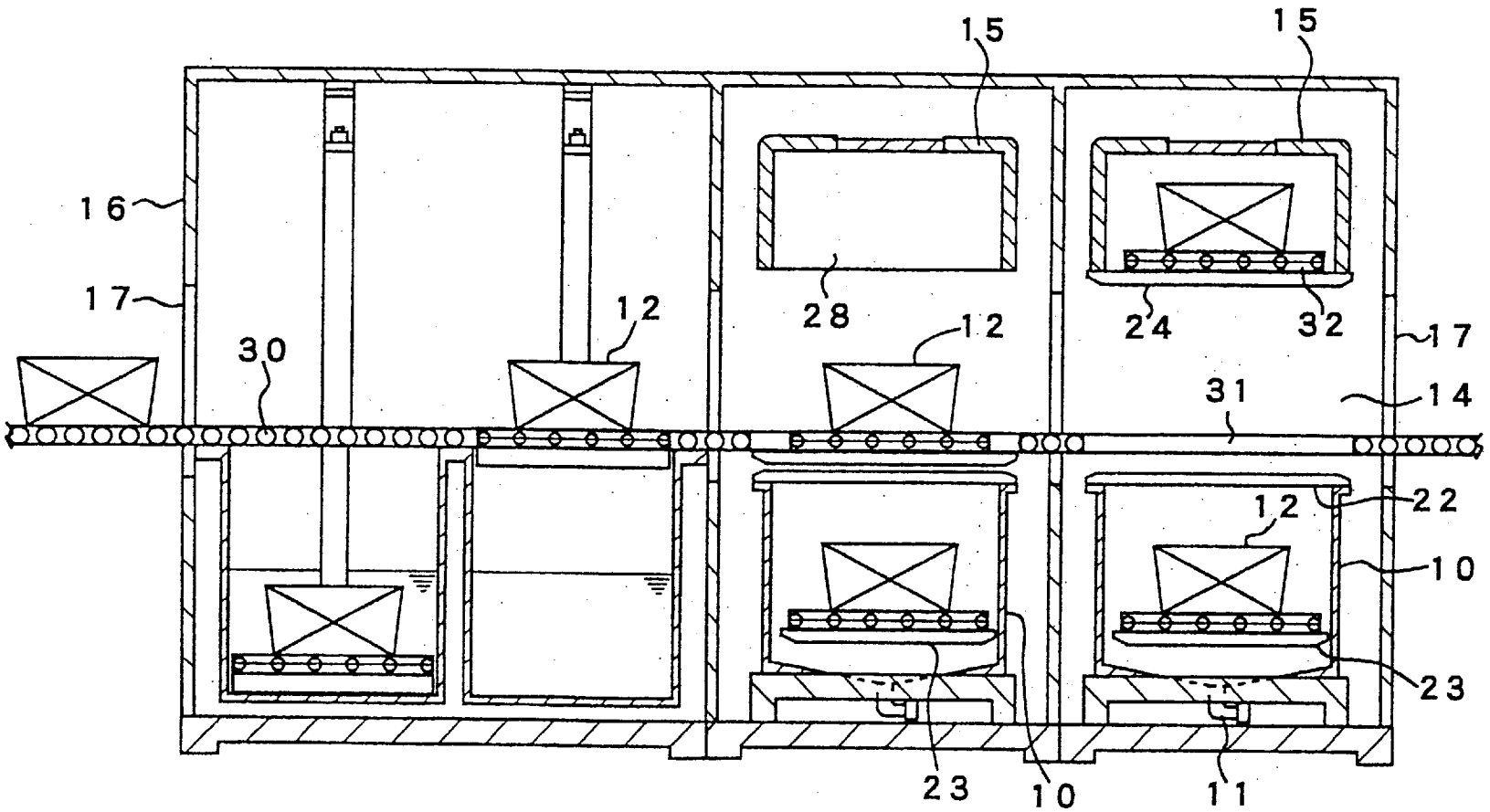
FIG. 8 is a cross section of an embodiment having two washing processing vats disposed laterally and disposing each two of upper and lower vats according to the invention.

As shown in FIG. 8, a washing mechanism may be constituted by connecting a mechanism having a washing processing vat (1) only laterally to a previously known mechanism. With such an apparatus, the known apparatus implements washing works of relatively short period such as dip washing, and the apparatus according to the invention including the upper and lower vats (15), (10) implements the washing related works that require much time such as drying work, steam washing, and the like. According to this construction, the articles (12) can be washed in the same period of time on the basis of the transfer distance of the articles (12) when the upper and lower vats (15), (10) conducts the drying work, the steam washing work, or the like at the same time, even if the apparatus spends twice of, e.g., dip washing time to implement drying work, steam washing work, or the like on the basis of one piece of the articles (12). Therefore, it is unnecessary to stop the washing work line, and drying and steam washing works can be made to match the required time for dip washing work.

Figure 9:
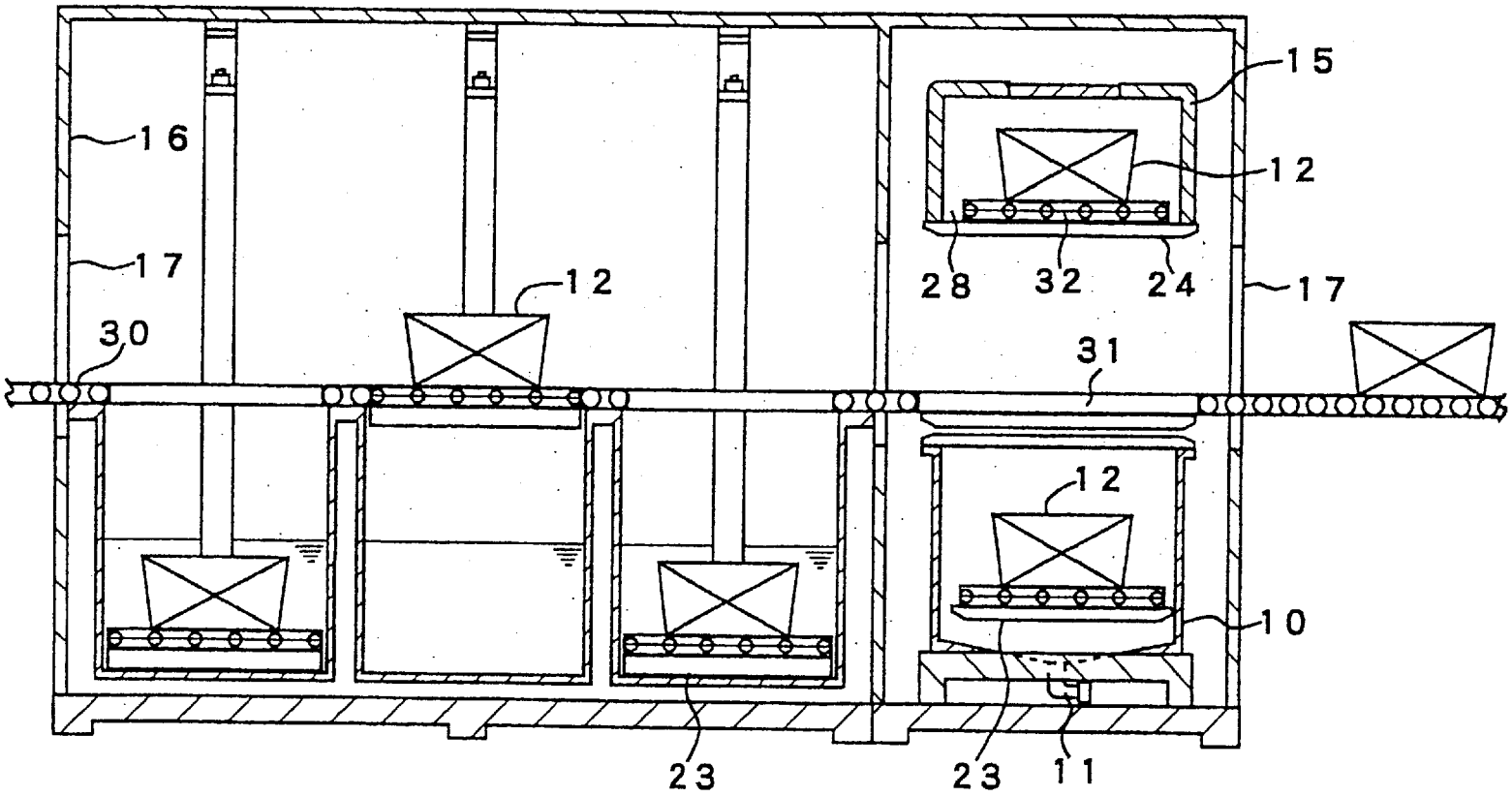
FIG. 9 is a cross section of an embodiment disposing three washing processing vats laterally and one pair of the upper and lower vats according to the invention.
Figure 13:
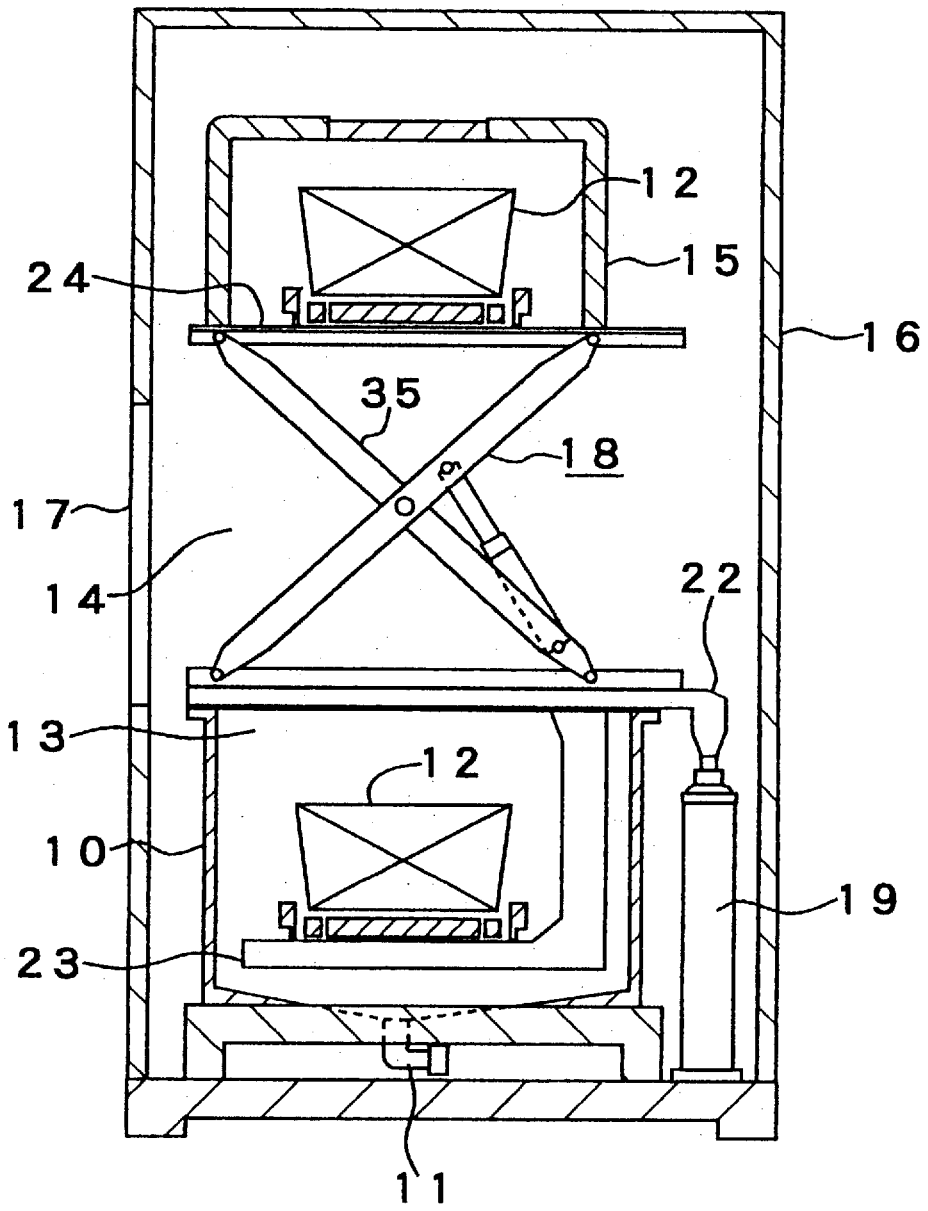
FIG. 13 is showing the modified embodiment of the upper vertical mover and is a cross section of a state that the articles on the upper table are contained in the upper vat by extension of a lift and the articles on the lower table are contained in the lower vat.

Although in an embodiment shown in FIG. 8 two known washing processing vats arranged laterally are provided to form two of the washing apparatuses made of the upper and lower vats (15), (10), the arrangement of the vats are determined arbitrarily according to the object of washing, and three washing processing vats arranged laterally and one apparatus according to the invention can be combined as shown in FIG. 9. Although in the embodiments above the upper and lower vertical movers (18), (19) are formed in parallel in a vertical direction in use of cylinders, in another embodiment the lower vertical mover (19) only is formed of a cylinder as shown in FIG. 13. A lift (35) is formed on a top face of the covering support (22) formed at the lower vertical mover (19), and the upper table (24) is disposed on the lift (35), thereby allowing the articles (12) to be contained in the upper vat (15). This lift (35) therefore operates as an upper vertical mover (18).

Figure 11:
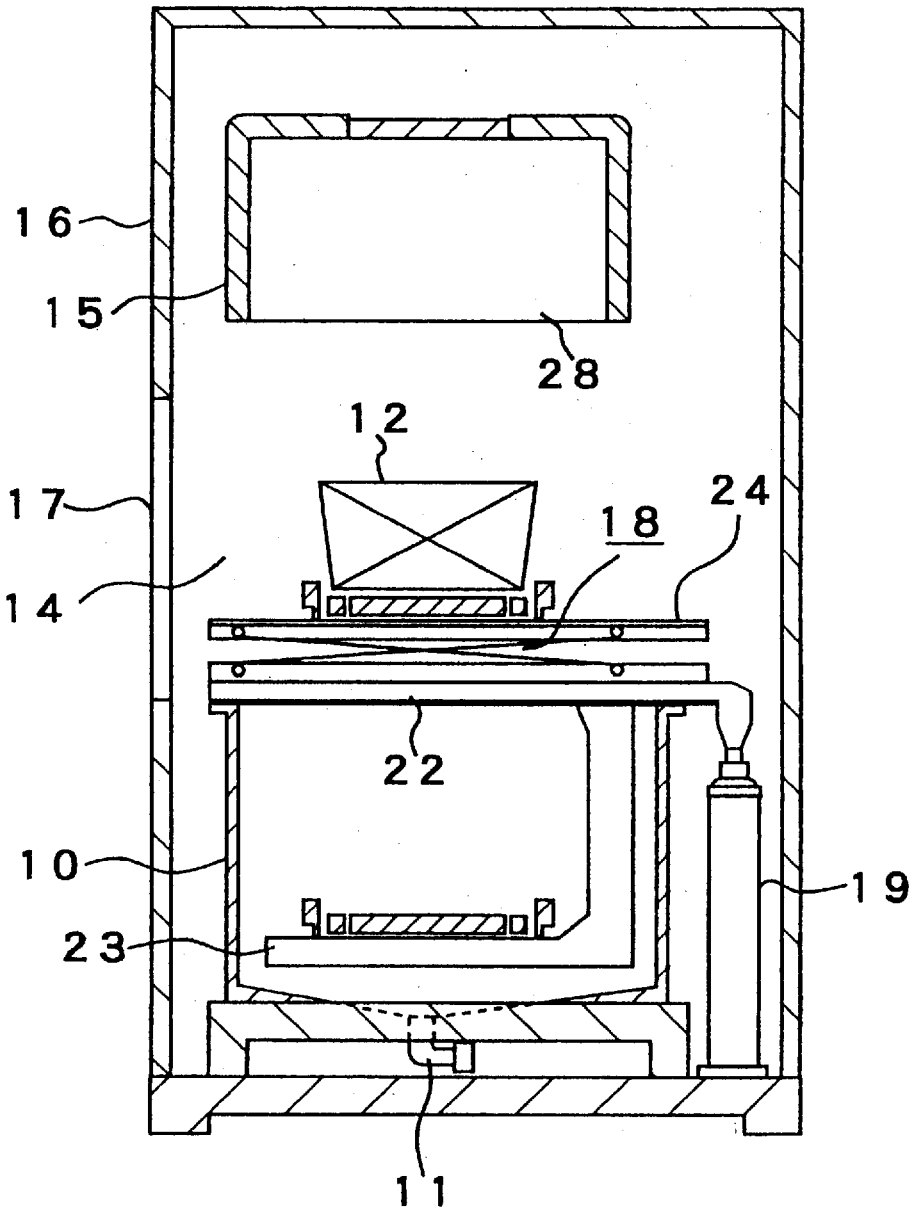
FIG. 11 is showing a modified embodiment of the upper vertical mover and is a cross section of a state that the upper table is placed at the loading and unloading space and the articles are put on the table.
Figure 12:
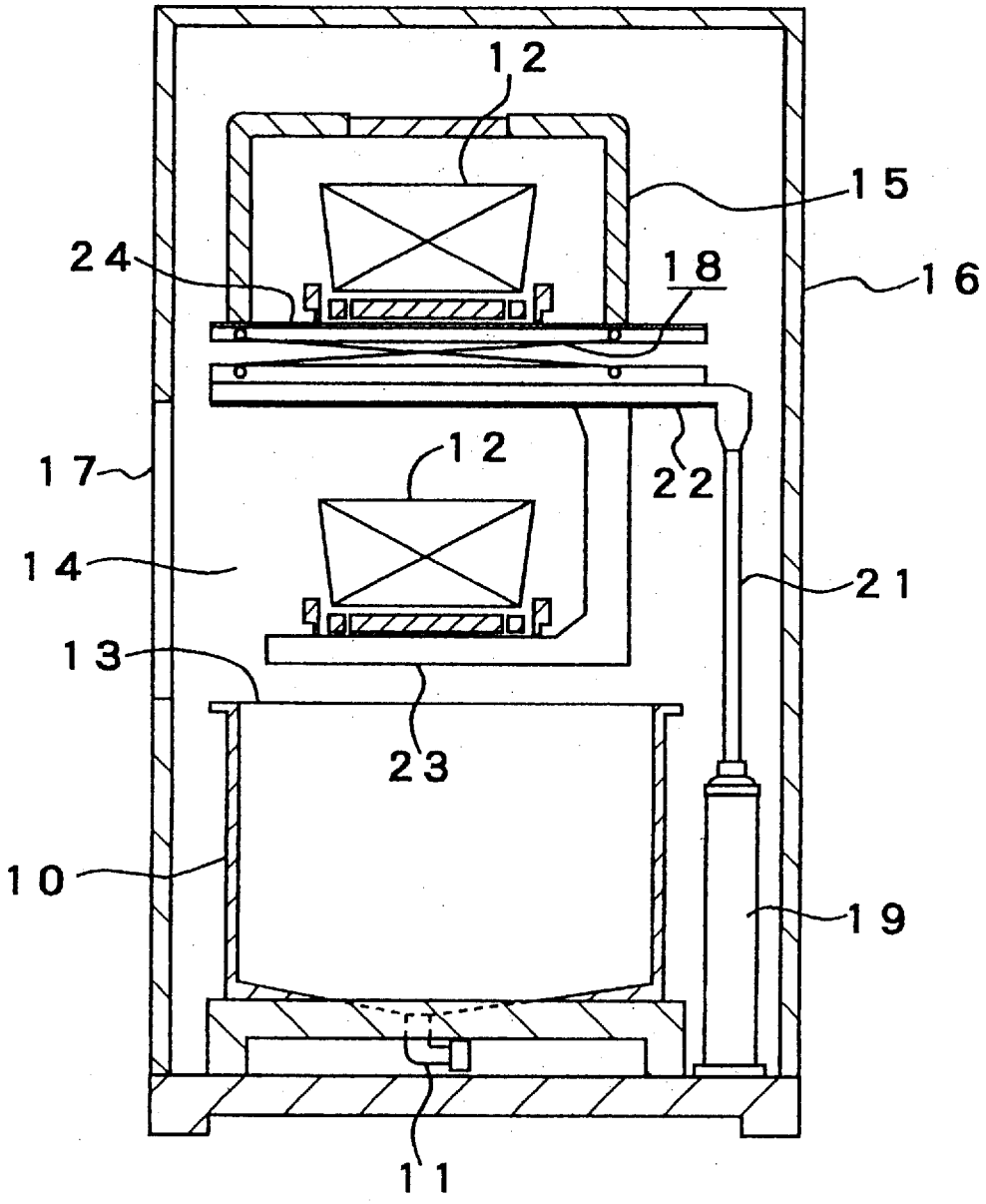
FIG. 12 is showing the modified embodiment of the upper vertical mover and is a cross section of a state that the articles are put on the upper and lower tables, that the articles on the upper table are contained in the upper vat, and that the articles on the lower table are placed at the loading and unloading space.
Figure 14:
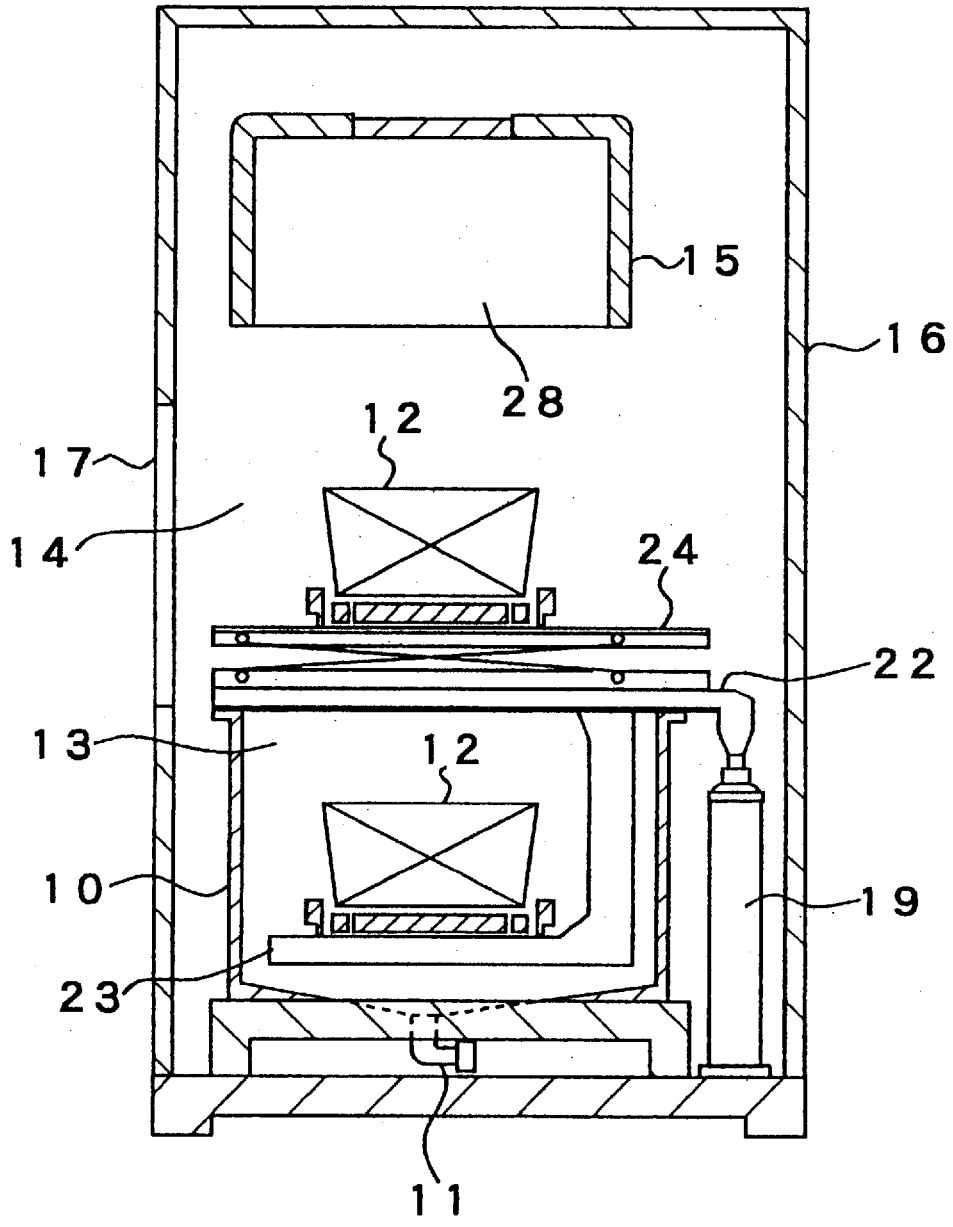
FIG. 14 is showing the modified embodiment of the upper vertical mover and is a cross section of a state that the articles on the upper table placed at the loading and unloading space and the articles on the lower table contained in the lower vat.
Figure 15:
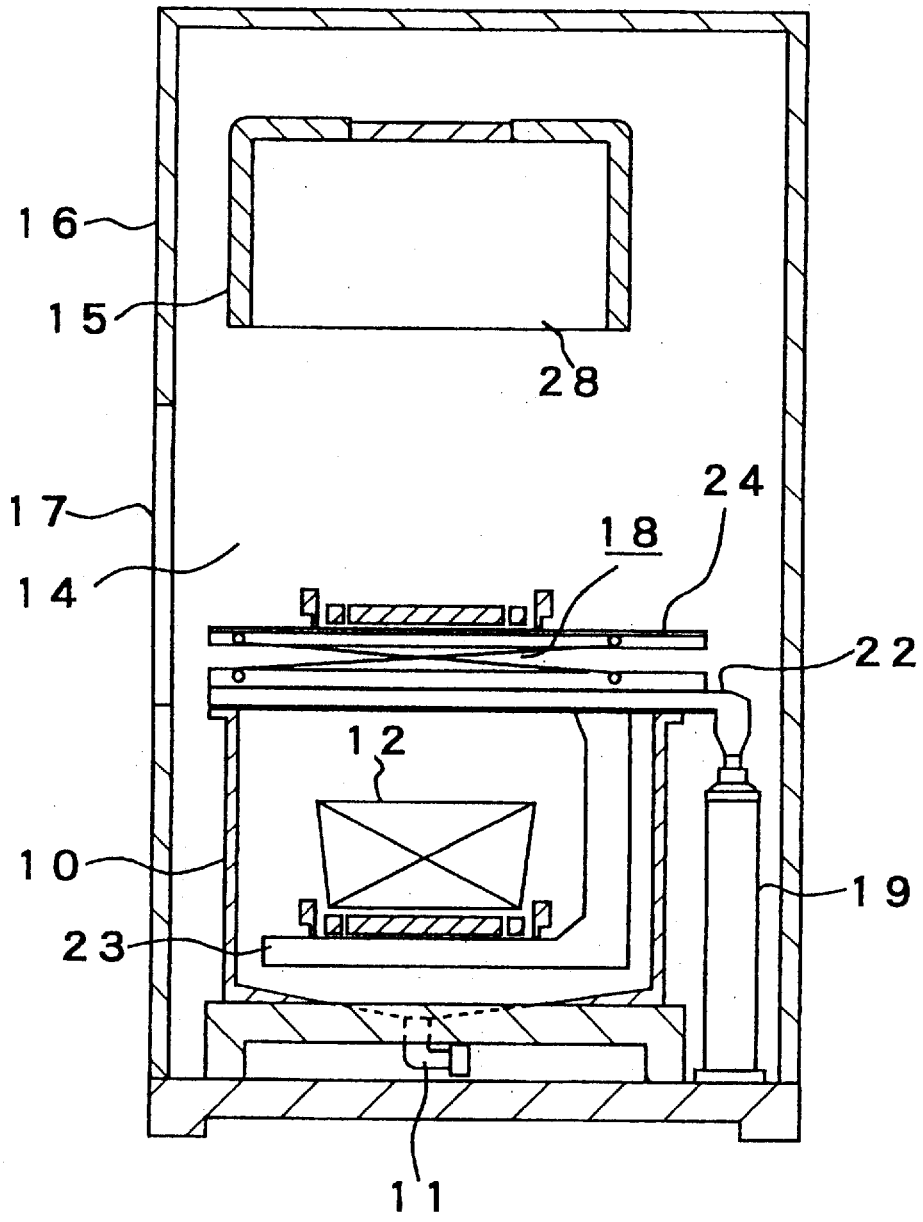
FIG. 15 is showing the modified embodiment of the upper vertical mover and is a cross section of a state that the articles on the upper table are taken out of the loading and unloading space and the articles on the lower table are contained in the lower vat.
Figure 16:
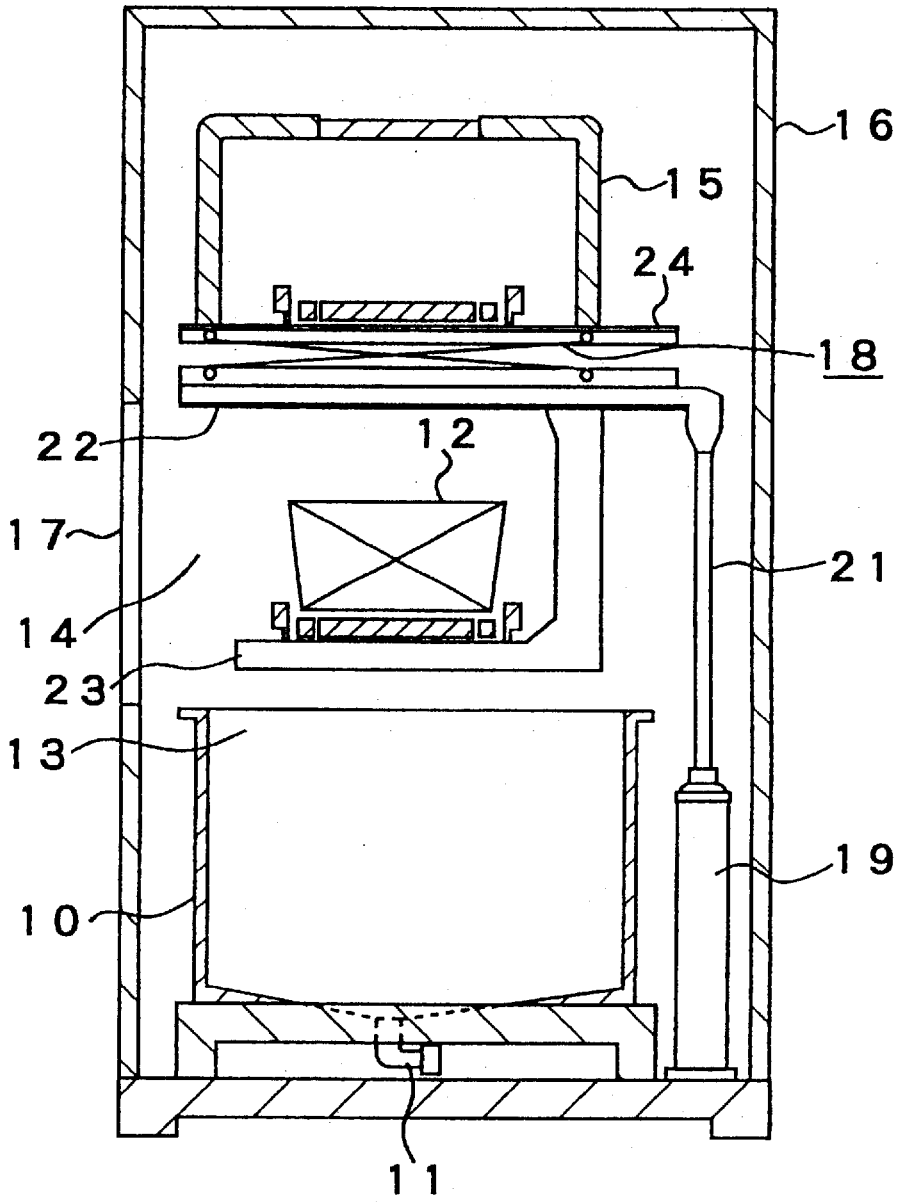
FIG. 16 is showing the modified embodiment of the upper vertical mover and is a cross section of a state that the upper and lower tables are moved up after the state shown in FIG. 15 and the articles on the lower table are placed at the loading unloading space.
Figure 17:
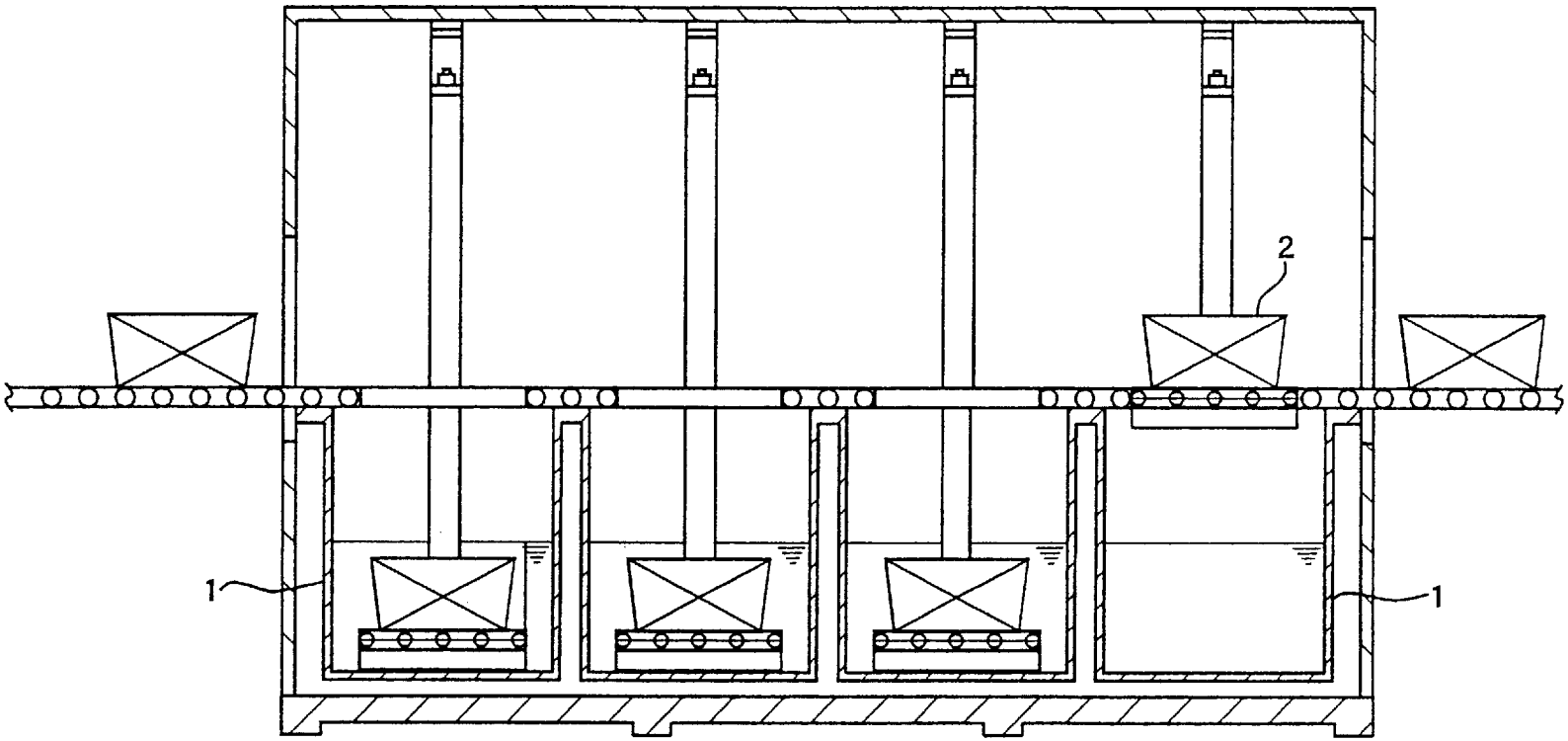
Fig. 17 Prior Art
FIG. 17 is a cross section showing a prior art.

With this situation, the steps for washing are entirely the same as those of the above embodiments; first as shown in FIG. 11, the lower vertical mover (19) is operated to move to the lowermost position while the lift (35) as an upper vertical mover (18) is contracted, thereby placing the upper table (24) at the loading and unloading space (14), and putting the articles (12) on the upper table (24) through the opening (17) of the casing (16). Then, as shown in FIG. 13, the lower vertical mover (19) is moved up to tightly contact the upper table (24) to the bottom face of the upper vat (15), thereby containing the articles (12) in the upper vat (15). The articles (12) are then put on the lower table (23) placed at the loading and unloading space (14) for articles (12). The lift (35) is extended as well as the lower vertical mover (19) is moved down; by rendering the lower table (23) contained in the lower vat (10), the articles (12) are separately contained in the upper and lower vats (15), (10), respectively, as shown in FIG. 13. With this situation, separate or the same washing related works are done at the upper and lower vats (15), (10). After completion of this washing, as shown in FIG. 14, the lift (35) is made to contract to move the upper table (24) to the loading and unloading space (14), thereby removing the articles (12) on the upper table (24) as shown in FIG. 15. As shown in FIG. 16, the lower vertical mover (19) is then moved up to locate the lower table (23) at the loading and unloading space (14), thereby allowing the articles (12) to be taken out through the opening (17). It is to be noted that, as well as in the embodiments above, sequences of moving up and down of the upper and lower tables (24), (23) and steps for putting the articles (12) are determined arbitrarily according to the object of washing.

Industrial Applicability

This invention is a washing apparatus suitable for washing mechanical parts, electrical parts, medical parts, etc. This washing apparatus has two vertically installed vats within an occupied area for a single vat, and any of the upper and lower vats can do washing works at the same time. Since the upper and lower vats are used simultaneously according to the object of washing, this washing apparatus is suitable for implementing quick washing works of the articles within a compact space.

I claim:

1. A washing apparatus comprising a lower vat capable of containing articles to be washed, an upper vat disposed above a top of the lower vat capable of containing articles to be washed, a loading and unloading space for articles formed between the upper vat and the lower vat, a lower vertical mover for the lower vat loading and unloading the articles to be washed in and out of the lower vat, and an upper vertical mover for the upper vat loading and unloading the articles to be washed in and out of the upper vat, wherein the articles to be washed are contained in the upper and lower vats at the same time and washing related works are done at the same time.

2. The washing apparatus according to claim 1, wherein the washing related works include dip washing.

3. The washing apparatus according to claim 1, wherein the washing related works include shower liquid washing.

4. The washing apparatus according to claim 1, wherein the washing related works include steam washing.

5. The washing apparatus according to claim 1, wherein the washing related works include drying of the articles to be washed.

6. The washing apparatus according to claim 1, wherein the upper vertical mover is formed of a cylinder.

7. The washing apparatus according to claim 1, wherein the upper vertical mover is formed of a lift.

8. The washing apparatus according to claim 1, wherein the lower vertical mover is formed of a cylinder.

9. The washing apparatus according to claim 1, wherein the upper vertical mover is connected to an upper table on which the articles are put.

10. The washing apparatus according to claim 9, wherein the upper table is capable of sealing a bottom opening of the upper vat where the articles are contained in the upper vat.

11. The washing apparatus according to claim 1, wherein the lower vertical mover is connected to a lower table on which the articles are put via a covering support.

12.The washing apparatus according to claim 11, wherein the covering support is capable of sealing a top opening of the lower vat where the articles are contained in the lower vat by the lower table.

* * * * *